US005130752A

United States Patent [19]

Morishita et al.

[11] Patent Number: 5,130,752

[45] Date of Patent: Jul. 14, 1992

[54] TRANSFER DEVICE WITH A RIBBED GUIDING MEMBER

[75] Inventors: Hiroki Morishita, Nara; Makoto Eki, Osaka, both of Japan

[73] Assignee: Mita Industrial Co., Ltd., Osaka, Japan

[21] Appl. No.: 523,537

[22] Filed: May 15, 1990

[30] Foreign Application Priority Data

May 24, 1989 [JP] Japan ..... 1-60253[U]
Jun. 30, 1989 [JP] Japan ..... 1-77908[U]
Aug. 28, 1989 [JP] Japan ..... 1-222673

[51] Int. Cl.[5] ..... G03G 15/16

[52] U.S. Cl. ..... 355/274; 355/273; 355/311

[58] Field of Search ..... 355/271, 272, 273, 274, 355/276, 311, 308, 309, 275; 271/2, 226, 234, 239, 240, 248, 264, 278, 250, 251, 188, 209; 26/51; 400/626, 642

[56] References Cited

U.S. PATENT DOCUMENTS 3,624,874 12/1971 Lauchenauer ..... 26/51 X
3,877,560 4/1975 Shimodaira et al. ..... 400/636 X
4,214,740 7/1980 Acquaviva ..... 271/188 X
4,369,729 1/1983 Shigenobu et al. ..... 355/271
4,525,057 6/1985 Kaufmann et al. ..... 355/309 X
4,579,441 4/1986 Hart et al. ..... 355/315
4,624,549 11/1986 Katoh ..... 355/275
4,739,363 4/1988 Hoshika et al. ..... 355/274
4,744,555 5/1988 Naramore et al. ..... 271/251
4,769,676 9/1988 Mukai et al. ..... 355/270
4,801,975 1/1989 Kano et al. ..... 355/218
4,843,214 6/1989 Higashi et al. ..... 355/309 X
4,908,668 3/1990 Takamatsu et al. ..... 355/274
4,995,504 2/1991 Kühn ..... 271/251 X

FOREIGN PATENT DOCUMENTS 126571 7/1984 Japan .
0026560 2/1985 Japan .
0163385 7/1988 Japan ..... 355/271
0292152 11/1988 Japan .

OTHER PUBLICATIONS

Fink et al., Standard Handbook for Electrical Engineering, 1978, pp. 4-143-4-148.

*Primary Examiner*—A. T. Grimley
*Assistant Examiner*—Robert Beatty
*Attorney, Agent, or Firm*—Beveridge, DeGrandi & Weilacher

[57] ABSTRACT

An image forming apparatus including a transfer discharger. A sheet material after transfer is detached from a photosensitive drum by virtue of its stiffness and its own weight. The sheet material detached from the drum is guided by a guiding member. The guiding member is made of insulating material and provided with a plurality of ribs. A charge removing member is disposed on a downstream side of the guiding member. Charge removing action occurs over spaces between the ribs and charges on a rear surface of the sheet material are removed as the sheet material is being guided by the ribs. The guiding member may be formed of antistatic material in at least a part of it which comes into contact with the sheet material. Further, the guiding member may include assisting guide portions in at least some of the spaces between the ribs for guiding a receiving substrate such as a sheet material, an envelope, or the like to upper portions of the ribs.

9 Claims, 9 Drawing Sheets

TRANSFER DEVICE WITH A RIBBED GUIDING MEMBER

BACKGROUND OF THE INVENTION

1. Field of the Invention

The present invention relates to an image forming apparatus such as an electrophotographic copying machine, a laser printer, an electrophotographic facsimile or the like, and more particularly, to an image forming apparatus provided with a guiding member which is disposed on a downstream side of a transferring device in a feed direction.

2. Description of the Prior Art

Recently, image forming apparatus are getting smaller in size for personal use. Therefore, it is difficult to provide a particular separating device such as a separating discharger for separating a receiving substrate such as a sheet material from an image bearing member after transfer. It may otherwise be provided with a separating belt, but an image cannot be formed at a portion where the separating belt is positioned, so that the copy produced lacks a part of image and it is not desirable for copy quality. On the other hand, as the image bearing member such as a photosensitive drum gets small, the sheet material can be detached from the photosensitive drum without any particular separating devices. In other words, if the photosensitive drum has a relatively big curvature, the sheet material is detached from the photosensitive drum by virtue of its stiffness and its own weight.

However, there are many charges on a rear surface of the sheet material which is detached from the photosensitive drum by itself. As a result, a downstream part of the sheet material after being detached from the photosensitive drum waves in the feed direction during conveyance because of the charges on the rear surface of the sheet material. The waves are transmitted from the downstream part of the sheet material to an upstream part thereof onto which a toner image on the photosensitive drum is being transferred, which causes inferior transfer. Therefore, the charges on the rear surface of the sheet material have to be removed as soon as possible after detachment from the photosensitive drum.

However, if a conductive material is provided in close vicinity of the transferring device such as a transfer discharger, charges from the transfer discharger flows as an electric current through the conductive material to the ground, which also causes inferior transfer due to lack of charges for transfer. And even if the conductive material is disposed so that the sheet material may come into contact with the conductive material after detachment from the photosensitive drum, the charges on the rear surface of the sheet material flows as an electric current through the conductive material rapidly, which causes crumbling of the toner image on the sheet material due to the shock.

There is proposed an image forming apparatus disclosed in Japanese Patent Laid-Open Publication No. 126571/1984. This image forming apparatus comprises a transfer discharger, an insulating member and a charge removing member which are provided in this order in a sheet feed direction. The charge removing member is provided for removing the charges on the rear surface of the sheet material, after the sheet material is detached from the photosensitive drum by virtue of its stiffness and its own weight. And the insulating member is provided between the transfer discharger and the charge removing member in order that the charges from the transfer discharger may not flow as an electric current to the charge removing member.

However, the conventional apparatus has a following problem. That is, the charge removing member is helpful for removing the charges on the rear surface of the sheet material as described hereinabove, but the insulating member is provided on the upstream side of the charge removing member, which diminishes the charge removing action of the charge removing member and delays timing of the charge removing. More concretely, an area of the charge removing action performed by the charge removing member is not limited to an outer edge of the charge removing member, but extends over the circumference. However, the insulating member disposed on the upstream side of the charge removing member cuts off the charge removing action. On the other hand, particularly, when the receiving substrate is not a plain paper but a sheet used for an Over Head Projector (OHP), said OHP sheet holds many charges, therefore the charges have to be removed certainly and effectively.

However, in the conventional apparatus, the charge removing action cannot spread over the insulating member, thus the charges cannot be removed immediately and sufficiently. As a result, some of the problems discussed hereinabove, that is, the waves of the sheet material accompanied with the inferior transfer cannot be prevented.

Moreover, the insulating member holds many electrostatic charges which comes from the transfer discharger and are generated as the sheet materials pass many times. The electrostatic charges on the insulating member used for a guiding member causes not only poor conveyance of the sheet material but also adhesion of toners. The poor conveyance of the sheet material causes crumbling of toner image on the downstream part of the sheet material which is detached from the photosensitive material, and also causes inferior transfer on the upstream part of the sheet material onto which the toner image on the photosensitive drum is being transferred, and further causes a sheet jam.

The toners adhesion causes stains of the sheet material which is conveyed on the insulating member used for the guiding member. More particularly, if the transfer discharger is the type which a part of an opening of the transfer discharger is covered with a part of the guiding member, the problem is more serious. That is, the guiding member covers the part of the discharger's opening in order to regulate a breadth of discharging area and to prevent a tip of the sheet material from entering inside of the transfer discharger, but the guiding member is charged by the transfer discharger because of its insulation. The guiding member covering the part of said opening is made of insulating material in order to prevent the inferior transfer due to the electric current flow. Thus, the charged guiding member attracts floating toners scattered in the neighborhood of the photosensitive drum. And the toners adhere to the surface of the guiding member, thus the tip and the rear surface of the sheet material becomes dirty when the sheet material is guided by the guiding member.

SUMMARY OF THE INVENTION

It is an object cf the present invention to provide a novel and improved image forming apparatus which is capable of charge removing as soon as the sheet material is detached from the photosensitive drum without causing inferior transfer or crumbling of the toner image on the sheet material.

It is another object of the present invention to provide a novel and improved image forming apparatus which is capable of preventing the guiding member near the transfer discharger from being charged.

It is a further object of the present invention to provide a novel and improved image forming apparatus which is capable of smooth conveyance of the sheet material, an envelope and so on.

Further objects of this invention, features and advantages will become apparent from the following detailed description taken in conjunction with the accompanying drawings.

DETAILED DESCRIPTION OF PREFERRED EMBODIMENTS

With reference to the accompanying drawings, specific embodiments of the image forming apparatus constructed in accordance with this invention will be described in detail.

Figure 1:
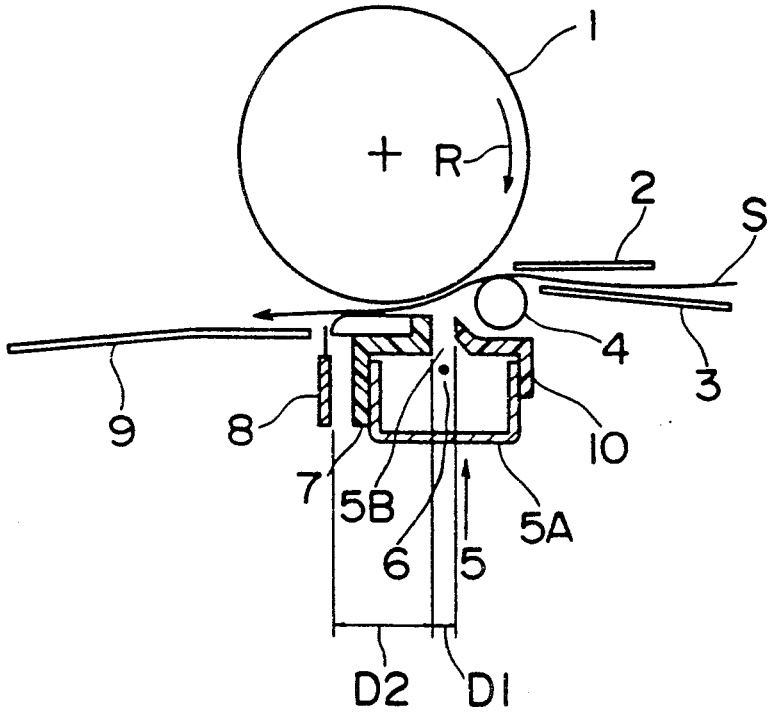
FIG. 1 is a sectional view showing a first embodiment of the present invention.

FIG. 1 is a sectional view showing a schematic configuration of a first embodiment of this invention incorporated in an image forming apparatus. The image forming apparatus comprises a photosensitive drum 1 used for an image bearing member. The photosensitive drum 1 rotates in a direction shown as an arrow R in FIG. 1 at a constant speed and an electrostatic latent image formed on a surface of the drum 1 is developed by a developing device (not shown) and made into a toner image. On the other hand, a sheet material used for a receiving substrate, such as a plain paper, an OHP sheet or so like, is fed as shown as an arrow S, synchronizing with the rotation of the photosensitive drum 1.

More concretely, a transfer discharger 5 used for a transferring means is disposed facing the photosensitive drum 1. On the upstream side of the transfer discharger 5 in the feed direction are disposed guiding members 2, 3 and a roller 4. And the sheet material guided by the guiding members 2, 3 is fed to the surface of the photosensitive drum 1 by the roller 4 and comes into contact with the drum 1.

The transfer discharger 5 comprises a discharging wire 6 and a U-shaped case 5A which is made of an electric conductor such as iron and surrounds the wire 6. The transfer discharger 5 has an opening 5B and the opening 5B faces the photosensitive drum 1. An upstream part of the opening 5B is covered with a discharging breadth regulating member 10 made of insulating material. And a downstream part of the opening 5B is covered with an upstream portion of a guiding member 7 (a flat portion 72 in FIG. 3). And both the discharging breadth regulating member 10 and said flat portion 72 of the guiding member 7 regulates the breadth of the discharging area. Particularly, the discharging breadth regulating member 10 is effective to prevent disturbance of the toner image. That is, if there is not said member 10, image transfer may begin before the sheet material comes into contact with the drum 1 perfectly, therefore, the toners on the drum 1 may jump toward the sheet material, and the image may be crushed out of shape. And the smaller the drum 1 becomes, the more remarkable the tendency becomes. On the other hand, if there is not the flat portion 72 of the guiding member 7, the sheet material may not be detached from the drum 1 by itself. In our experiment, a good result was obtained when a diameter of the drum 1 was 40 millimeters and the breadth of discharging area (the distance D1 in FIG. 1) is 4 millimeters. Moreover, the flat portion 72 of the guiding member 7 also prevents the sheet material from entering inside of the transfer discharger 5. However, if the transfer discharger 5 is small enough corresponding to the drum 1, it may be good without the discharging breadth regulating member 10 or the flat portion 72 of the guiding member 7.

The toner image formed on the photosensitive drum 1 is transferred onto the sheet material by corona discharging from the wire 6. Subsequently, the sheet material onto which the toner image is transferred is detached from the photosensitive drum 1 by itself by virtue of its stiffness and its own weight. It is because the photosensitive drum 1 is small in diameter, that is, it has a relatively big curvature. In our experiment, the drum 1 was 40 millimeters in diameter and a good result was obtained. However, if it is not more than 50 millimeters, the sheet material is detached from the drum 1 by itself.

On the downstream side of the transfer discharger 5 are charge removing means, and a guiding member 9 in this order in the feed direction.

After the sheet material is detached from the photosensitive drum 1, it is guided by the guiding member 7 and residual charges on a rear surface of the sheet material are removed by the charge removing brush 8. Subsequently, the sheet material is guided by the guiding member 9.

Figure 2:
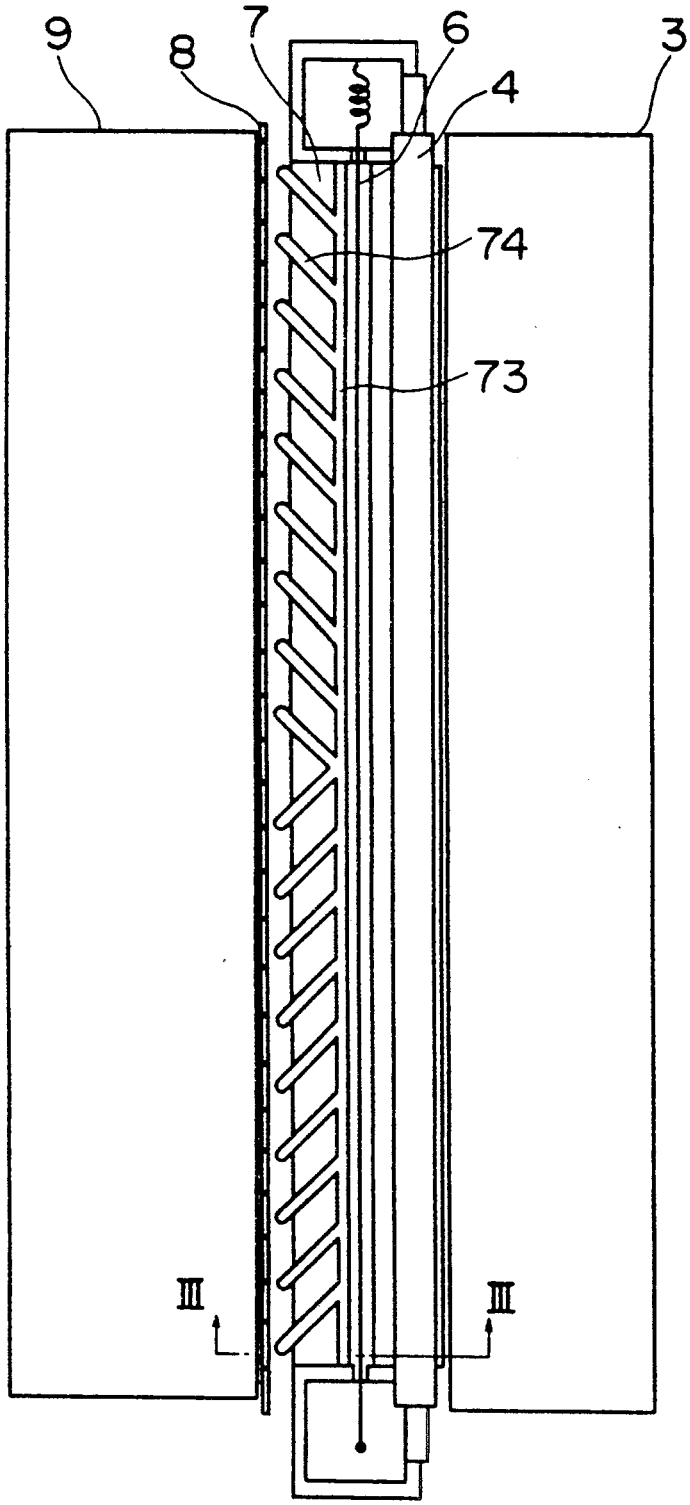
FIG. 2 is a plan view showing a transfer discharger and peripheral members of FIG. 1.
Figure 3:
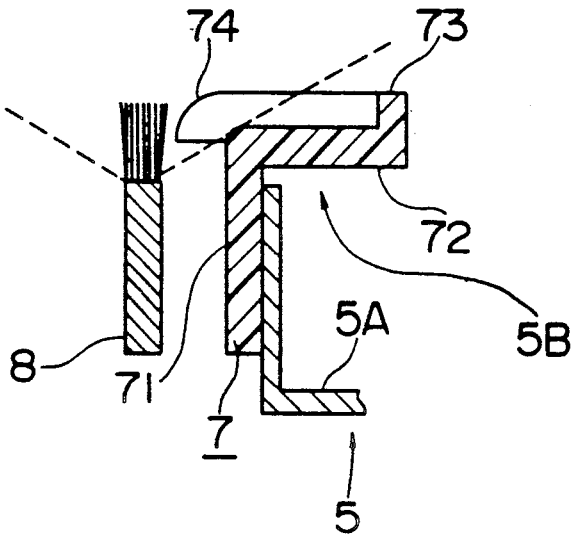
FIG. 3 is a sectional view taken on line III—III in FIG. 2.

FIG. 2 is a plane view of the embodiment, and FIG. 3 is a sectional view taken on line III—III in FIG. 2.

The guiding member 7 has a hook-like shape in section. That is, the guiding member 7 comprises an upright portion 71 which is in contact with a downstream side surface of said case 5A, the flat portion 72 covering the part of the opening 5B adjacent to said upright portion 71, and an upright portion 73 adjacent to said flat portion 72. The flat portion 72 and the upright portion 73 regulates the breadth of discharging area and prevents the sheet material from entering inside of the transfer discharger 5 as described hereinabove.

The guiding member 7 further comprises a plurality of ribs 74 on the upper surface of the flat portion 72 adjacent to said upright portion 73. The ribs 74 are disposed in an intersecting direction to the feed direction, with leaving spaces between them. More minutely, the ribs 74 spread out like an unfolded fan. That is, the ribs 74 are disposed so that a downstream side of each rib tends outward. The configuration is effective to prevent the sheet material from waving in an intersecting direction to the feed direction. That is, taking notice of each one of the ribs, the sheet material is supported on the rib which is provided in an intersecting direction to the feed direction, therefore the sheet material scarcely hangs down at a space between the rib and the adjacent rib, even if the sheet material is pressed down by forces such as its own weight, a force generated in relation to a convey force and so on. Moreover, the configuration is also effective in point that the sheet material is stretched outwardly. Accordingly, the sheet waves in an intersecting direction to the feed direction are prevented. This means that inferior transfer is prevented. Downstream ends of the ribs 74 project downstream with respect to the flat portion 72 beyond the downstream edge 72E to near and adjacent to the charge removing brush 8. Moreover, the charge removing brush 8 is disposed so that a tip of the brush 8 may be positioned lower than upper portions of the ribs 74 as shown in FIGS. 1 and 3. Accordingly, a sheet jam does not occur. The guiding member 7 has said configuration, thus the sheet material is guided by the upper portions of the ribs 74 used for guide portions. Further, the charge removing action of the charge removing brush 8 spreads over the spaces between the ribs 74 as shown in dot lines in FIG. 3. Accordingly, the charge removing action is not be cut off by the guiding member 7 and charges on the rear surface of the sheet material are removed when the sheet material is being guided by the ribs 74. And the higher the height of the ribs 74 is, the less cutting off the charge removing action becomes. It is noted that the height of the ribs 74 is a distance between the upper surface of the flat portion 72 and the upper portions of the ribs 74. Further, it is noted that the guiding member 7 is made of the insulating material and the charge removing brush 8 is made of electrically conducting material connected to ground potential. As the guiding member 7 is made of insulating material, the charges from the transfer discharger 5 do not flow as an electric current to the charge removing brush 8. Therefore, it can prevent inferior transfer caused by the lack of charges for transfer. Further, the sheet material which is detached from the drum 1 comes into contact with the guiding member 7 made of the insulating material, therefore, it can prevent the crumbling of the toner image on the sheet material caused by rapid electric current flow. And as disclosed hereinabove, the ribs 74 are provided, therefore, the charge removing action of the charge removing brush 8 spreads over the spaces between the ribs 74 and the charges on the rear surface of the sheet material are removed when the sheet material is being guided by the ribs 74, thus the charges can be removed immediately and sufficiently. This means that the waves of the sheet material caused by the residual charges on the rear surface of the sheet material can be prevented. It is noted that the sheet material does not come into contact with the charge removing brush 8 directly when the sheet material has just been detached from the drum 1, but comes into contact with the ribs 74 in the state of being exposed by the charge removing action. Therefore, the action is faint enough not to crumble the toner image on the sheet material. From this point of view, it is preferable that the tip of said charge removing brush 8 is disposed at a position lower than the upper portions of the ribs 74 and the sheet material is out of contact with the charge removing brush 8. Further, as the flat portion 72 disposed between the drum 1 and the transfer discharger 5 is also made of insulating material, the charges from the transfer discharger 5 does not flow as an electric current through the conductive material to the ground. Accordingly, charges needed for transfer are fed to the sheet material, and do not cause inferior transfer. It is noted that, in our experiment, a good result was obtained when the length of the guiding member 7 in the feed direction ( D2 in FIG. 1) was 9 millimeters. The length D2 is substantially equal to a distance between the downstream edge of the discharging area and the position of the charge removing brush 8.

Figure 4:
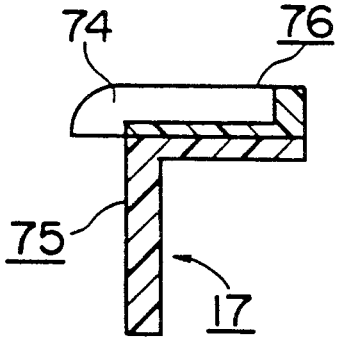
FIG. 4 is a sectional view showing a second embodiment of the guiding member of the present invention

FIG. 4 is a sectional view showing another embodiment of the guiding member. As shown in FIG. 4, a guiding member 17 comprises a lower guiding portion 75 and an upper guiding portion 76, and each may be made of other materials. Preferably, the lower guiding portion 75 is made of insulating material such as polycarbonate or so like, and the upper guiding portion 76 is made of antistatic material. The antistatic material is made by various kinds of methods. For example, the antistatic material is (1) a high molecular substance mixing of an antistatic agent (the antistatic agent is, for example, quaternary ammonium salt in U.S. Pat. No. 2,579,375, alkyl aryl sulfonate in U.S. Pat. No. 2,978,440, magnesium oxide in U.S. Pat. No. 2,758,984, or metallic compound such as zinc oxide, titanium oxide and so like in U.S. Pat. Nos. 2,887,632, 2,940,941, 3,062,700), or (2) a high molecular substance to which an antistatic agent is applied (the antistatic agent is, for example, alkyl sulfonate in U.S. Pat. No. 2,614,984, quaternary ammonium salt in U.S. Pat. No. 2,876,127, polyhydric alcohol in U.S. Pat. No. 2,955,960, or metallic oxide such as titanium oxide, tin oxide or so like in Japanese Patent Publication Nos. 6616/1960, 24890/1965). Preferably, antistatic material is made of resin and a good result was obtained when "TOYORAKKU PARERU 88Z" (the Trade Name of TORAY Co. Ltd.) was used. This antistatic material has a surface resistivity of not causing inferior conveyance of the sheet material and not causing toner to adhere to the guiding member 17. That is, the surface resistivity is from about $1\times10^{8}$ ohm-cm to about $1\times10^{12}$ ohm-cm. Therefore, the surface resistivity is smaller than that of an ordinary insulating resin (about $1\times10^{16}$ ohm-cm) and the antistatic material prevents the lower guiding portion 75 from being charged. Accordingly, the floating toners do not adhere to the upper guiding portion 76 much and the upper guiding portion 76 does not become so dirty by the toners. Further, it prevents the inferior conveyance of the sheet material which is accompanied with crumbling of the toner image and inferior transfer. In our experiment, a good result was obtained when an antistatic material having a surface resistivity of from about $1\times10^{11}$ ohm-cm to about $1\times10^{12}$ ohm-cm in relation to charged potential of the photosensitive drum 1 was used.

Further explaining the guiding member 17, the upper guiding portion 76 formed on the lower guiding portion 75 comprises a plurality of ribs 74 in the same way as the embodiment in FIG. 3. Accordingly, when the sheet material is guided by the upper portion of the ribs 74, the tip and the rear surface of the sheet material does not become dirty, moreover, the sheet material is conveyed smoothly. When the upper guiding portion 76 comprises the ribs 74, the area which is in contact with the sheet material is small, thus the sheet material is prevented from stains more effectively.

Figure 5:
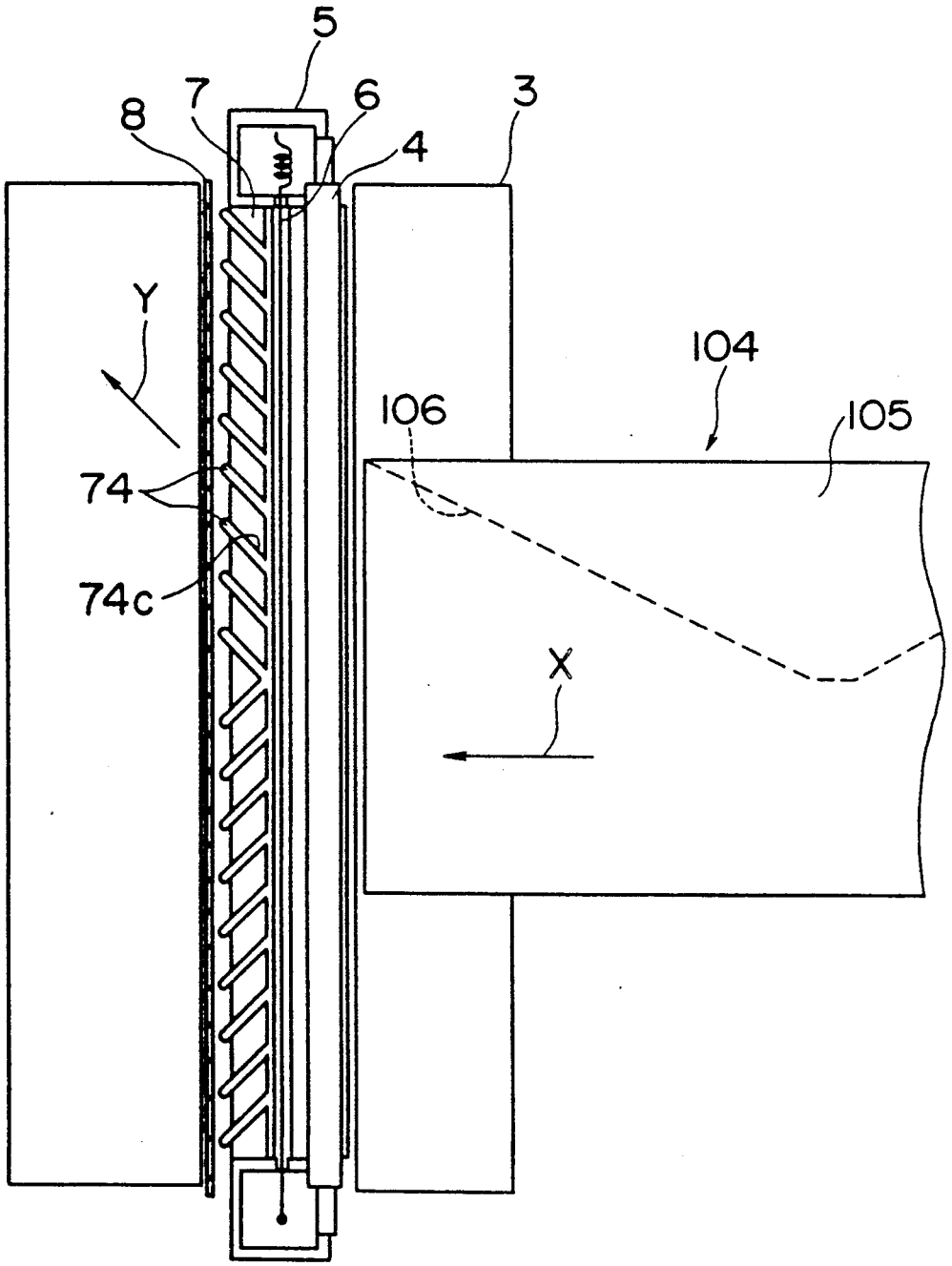
FIG. 5 is a view useful for explaining when an envelope is conveyed on the same guiding member as FIG. 2.

FIG. 5 is a view explaining a state when an envelope is conveyed on the same guiding member 7 as FIG. 2. The receiving substrate such as an envelope 104 has generally a flap portion 105 for sealing by sticking it down. The flap portion 105 has not been stuck down yet when the image is formed, and it faces down during conveying, thus the flap portion 105 hangs down. Therefore, an edge 106 of the flap portion 105 sometimes enters into one of the spaces between the ribs 74 and comes into contact with one of upright walls 74*c* of the ribs 74. It is noted that the upright walls 74*c* extend in an intersecting direction to the feed direction, and said one of the upright walls 74*c* guides the edge 106 of the envelope 104. As a result, the envelope 104 conveying in a direction shown as an arrow X in FIG. 5 turns aside in a direction shown as an arrow Y in FIG. 5 and transfer slip occurs. When the situation is worse, the envelope 104 jams. The next embodiment is the improvement of the embodiment of FIG. 2 and is shown in FIGS. 6 to 8.

Figure 6:
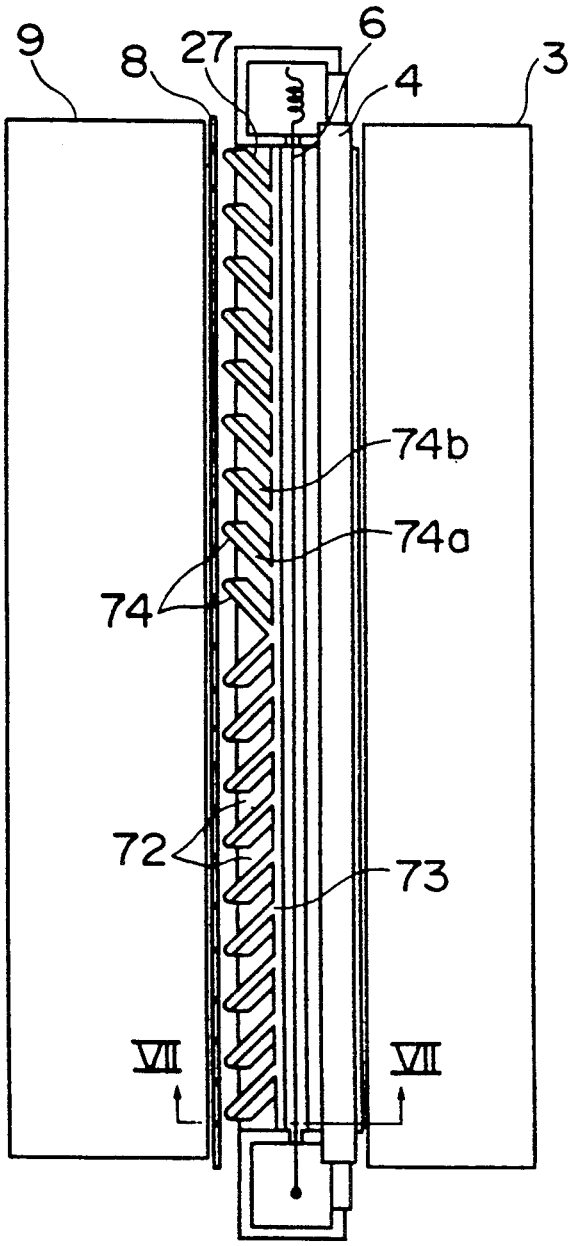
FIG. 6 is a plan view showing a third embodiment of the present invention corresponding to FIG. 2.
Figure 7:
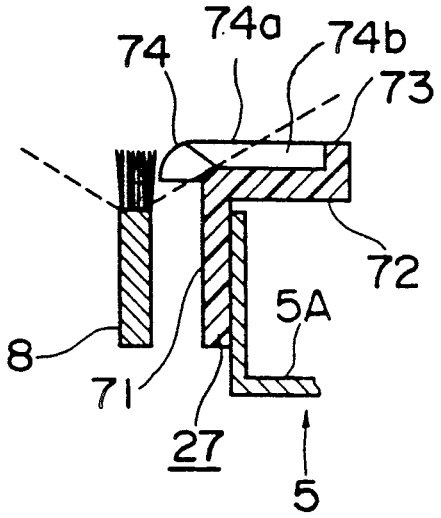
FIG. 7 is a sectional view taken on line VII—VII in FIG. 6 and corresponds to FIG. 3.
Figure 8:
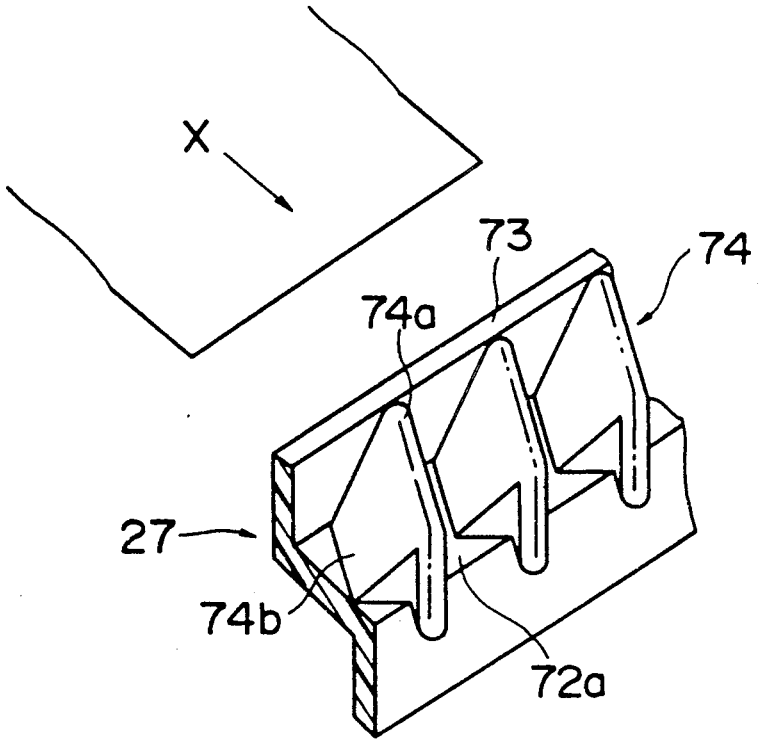
FIG. 8 is an enlarged perspective view showing a part of the guiding member of FIG. 6.

FIG. 6 is a plan view showing this embodiment, FIG. 7 is a sectional view taken on line VII–VII in FIG. 6, and FIG. 8 is an enlarged perspective view showing a part of ribs 74 of a guiding member 27 of FIG. 6.

The ribs 74 spread out like an unfolded fan. And the ribs 74 comprise guide portions 74*a* provided at the upper portion thereof for guiding the envelope 104 and assisting guide portions provided in the spaces therebetween. More concretely, each of the portion of each of the ribs 74 and assisting guide portions are declining portions 74*b* which decline from the guide portions 74*a* towards lowermost portions 72*a* of the spaces. The lowermost portions 72*a* of the spaces are coincident with an upper surface of said flat portion 72. In the case that the guiding member 27 has such a constructure, even if the flap portion 105 of the envelope 104 enters into one of the spaces between the ribs 74 during conveying, the edge 106 of the flap portion 105 is guided to the guide portions 74*a* by the declining portions 74*b*. Accordingly, the envelope 104 does not turn aside and does not jam. Moreover, the guiding member 27 still has spaces between the ribs 74 where said charge removing action of the charge removing brush 8 can spread over, as shown in dot lines in FIG. 7. Accordingly, the action is not cut off by the guiding member 27.

Figure 9:
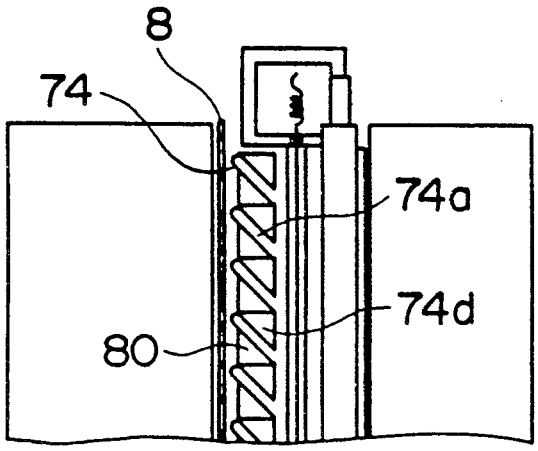
FIG. 9 is a plan view showing a fourth embodiment of the invention.
Figure 10:
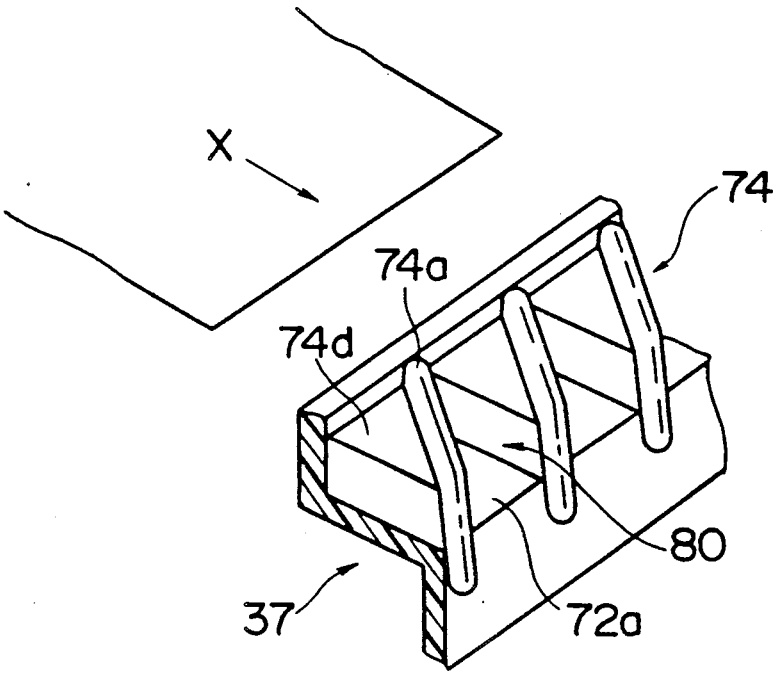
FIG. 10 is an enlarged perspective view showing a part of the guiding member of FIG. 9 and corresponds to FIG. 8.

FIGS. 9 and 10 show another embodiment of the assisting guide portions which constitute a part of a guiding member 37. This embodiment has flat tables 74*d* used for the assisting guide portions instead of the declining portions 74*b*. Each of the flat tables 74*d* is also provided at an upstream or outside portion of each of the ribs 74 which extends in the intersecting direction to the feed direction. The flat tables 74*d* are a little lower than the guide portions 74*a* but higher than the lowermost portions 72*a* of the spaces. The flat tables 74*d* and the lowermost portions formed where the lowermost portions 72*a* are positioned. That is, each of the spaces between ribs 74 is divided into two parts. One of the parts which faces the charge removing brush 8 remains as each of said space portions 80. And the other of the parts which is positioned in the vicinity of the transfer discharger 5 is filled in as each of said flat tables 74*d*. And each side of the flat tables 74*d* which faces each of the space portions 80 is preferably parallel to the feed direction. Accordingly, even if the envelope 104 enters into the flat tables 74*d*, the envelope 104 is guided to the guide portions 74*a* easily. And the guide portions 74*a* are a little higher than the flat tables 74*d* and spread out like an unfolded fan, thus the envelope 104 does not wave in an intersecting direction to the feed direction. Moreover, the charge removing action of the charge removing brush 8 spreads over said space portions 80, thus the charges on the rear surface of the envelope 104 can be removed effectively.

It is noted that it is necessary to provide the assisting guide portions in all of the guiding member as disclosed in the above embodiments shown in FIGS. 6 and 9, but they may be provided only in the parts where the flap portions of regular sizes envelopes are apt to hang down. Further, the guiding member in FIGS. 6 to 10 may be made of insulating material and antistatic material. And the antistatic material is provided on said insulating material and is provided in at least a part of the guiding member which comes into contact with the envelope 104.

In the above embodiments in FIGS. 6 to 10, the guiding member comprising the assisting guide portions is disposed in the vicinity of the transfer discharger 5, however, it may otherwise be disposed at a position or positions where the sheet material apts to wave and/or the sheet material is needed to be prevented from waving, for example, a portion on an upstream side of a fixing device and so on.

The guiding member is not limited to the above embodiments but otherwise various changes and modifications may be adopted.

Figure 11:
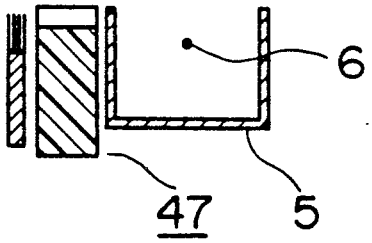
FIG. 11 is a sectional view showing a fifth embodiment of the guiding member and peripheral members of the present invention.
Figure 12:
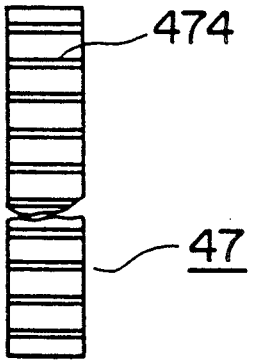
FIG. 12 is a plan view of the guiding member of FIG. 11.

FIGS. 11 and 12 show a further embodiment of the guiding member 47. FIG. 11 is a sectional view and FIG. 12 is a plan view of the guiding member 47 of FIG. 11. As shown in FIG. 11, the guiding member 47 made of insulating material or antistatic material does not cover a part of the opening of the transfer discharger 5 but has a rectangular shape in section and is disposed where it is adjacent to the downstream side of the transfer discharger 5. Further, the guiding member 47 comprises a plurality of ribs 474 which are parallel to the feed direction. In this case, the guiding member 47 is made of the insulating material or the antistatic material in whole, however, it may otherwise comprise a lower guiding portion made of the insulating material and an upper guiding portion made of the antistatic material.

Further, the ribs may be disposed so that a downstream side of each rib tends inward, contrary to the embodiment of FIG. 2.

Still further, the guiding member 47 made of the antistatic material in at least a part thereof which comes into contact with the sheet material may, otherwise, have a flat upper portion without ribs.

In the above embodiment in FIG. 4, the guiding member comprising the antistatic material is incorporated in the apparatus without a separating device.

Figure 13:
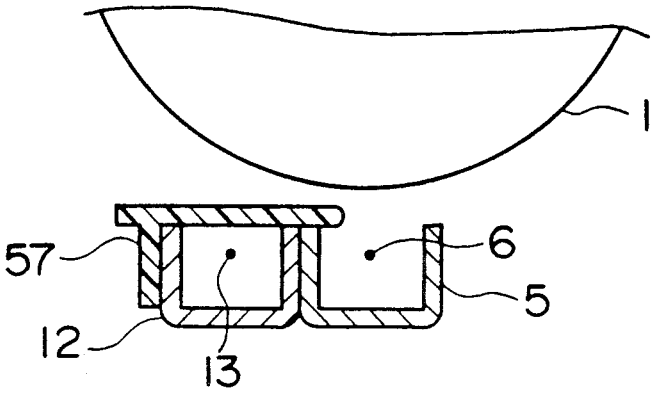
FIG. 13 is a sectional view showing a sixth embodiment of the invention.
Figure 14:
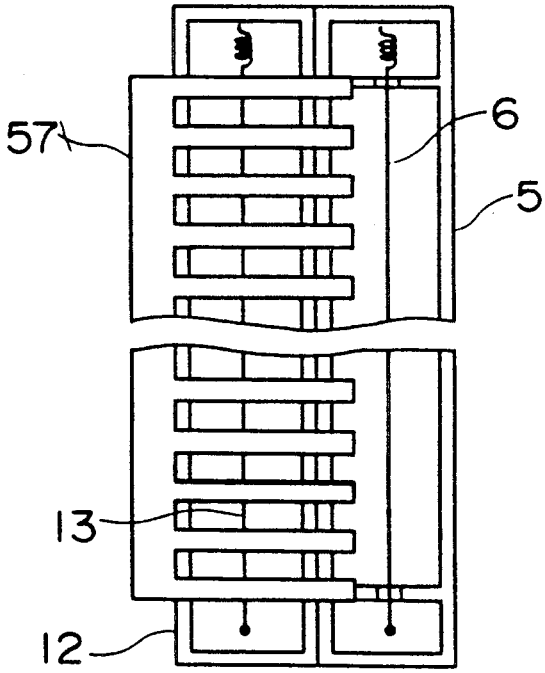
FIG. 14 is a plan view of FIG. 13.

However, it may otherwise be incorporated in an apparatus which is provided with the separating device. FIGS. 13 and 14 show this embodiment. FIG. 13 is a schematic sectional view and FIG. 14 is a plane view of FIG. 13.

In this embodiment, the image forming apparatus comprises a transfer discharger 5 and a separating discharger 12 which are provided near the photosensitive drum 1. The separating discharger 12 is provided on a downstream side of the transfer discharger 5 in the feed direction. The guiding member 57 has comb-like shape in the plane view (see FIG. 14), and preferably covers an opening of the separating discharger 12, further the upstream portion of the guiding member 57 preferably extends to cover a part of the opening of the transfer discharger 5, so that it may prevent the tip of the sheet material from entering inside the transfer discharger 5 and the separating discharger 12 confirmly. The guiding member 57 is also made of the antistatic material in at least a flat portion thereof. It is noted that the electrical current flows a little from the wire 13 to the antistatic material covering the opening of the separating discharger 12 in some portions, however, the separating discharger 12 discharges by an alternating current voltage, so said current flow to the antistatic material does not affect the separating ability.

In the above embodiment in FIG. 4, the guiding member 17 comprises the upper guiding portion 76 made of the antistatic material and the lower guiding portion 75 made of the insulating material. However, the guiding member 17 may otherwise be made of the antistatic material in only a part thereof which comes into contact with the sheet material. Further, the guiding member 17 may otherwise be made of the antistatic material entirely.

In the above embodiment, the charge removing brush 8 is used for the charge removing means, however, it may otherwise be a metallic roller having a rough surface, and charges are removed by projecting portions. Further, it may otherwise be a saw-shaped charge removing member, or it may be a needle-shaped charge removing member. These are shown in FIGS. 3 to 5 in Japanese Patent Laid-Open Publication No. 126571/1984.

What is claimed is:

1. An image forming apparatus comprising:

(A) an image bearing member having a relatively large curvature;

(B) transferring means for electrostatically transferring a toner image formed on said image bearing member onto a receiving substrate, said receiving substrate being detachable from said image bearing member by virtue of its stiffness and its own weight;

(C) an insulating member disposed on a downstream side of said transferring means in a feed direction of said receiving substrate, said insulating member having a downstream edge, (D) a plurality of ribs formed of material which has a surface resistivity that is greater than that of a conductive material, said ribs being provided on said insulating member for guiding said receiving substrate, said ribs having spaces therebetween, and said ribs having downstream portions which project downstream with respect to said insulating member, beyond said downstream edge thereof; and (E) charge removing means for attracting charges on a rear surface of said receiving substrate when it is detached from said image bearing member, said charge removing means being formed of said conductive material and being disposed in close vicinity to said downstream portions of said ribs, whereby charge removing action of said charge removing means spreads over said spaces between said ribs and charges on said rear surface of said receiving substrate are removed when said receiving substrate is being guided by said ribs.

2. An image forming apparatus of claim 1, wherein said ribs spread out like an unfolded fan.

3. An image forming apparatus of claim 1, wherein said insulating member comprises a plurality of assisting guide portions provided in at least some of said spaces for guiding said receiving substrate to upper portions of said ribs.

4. An image forming apparatus of claim 1, wherein an upstream portion of said insulating member covers a part of said transferring means, whereby said upstream portion regulates discharging area breadth and prevents said receiving substrate from entering inside said transferring means.

5. An image forming apparatus of claim 1, wherein said ribs are formed of antistatic material and antistatic material is provided on said insulating member.

6. An image forming apparatus of claim 1, wherein said charge removing means is of a brush-type.

7. An image forming apparatus of claim 1, wherein a tip of said charge removing means is disposed at a position lower than upper portions of said ribs, whereby said receiving substrate is out of contact with said charge removing means.

8. An image forming apparatus of claim 1, wherein said image bearing member is not more than 50 millimeters in diameter.

9. An image forming apparatus of claim 1, wherein said ribs are formed of insulating materials.

* * * * *